US010753186B1

(12) United States Patent
Zimmerman, Jr. et al.

(10) Patent No.: US 10,753,186 B1
(45) Date of Patent: Aug. 25, 2020

(54) SEALING PLUNGER LIFT SYSTEM AND TUBING CONNECTOR

(71) Applicant: Pivot Energy Solutions, LLC, Idaho Springs, CO (US)

(72) Inventors: Jeffrey Brian Zimmerman, Jr., Idaho Springs, CO (US); Jesson Adam Salyards, Severance, CO (US)

(73) Assignee: PIVOT ENERGY SOLUTIONS, LLC, Idaho Springs, CO (US)

( * ) Notice: Subject to any disclaimer, the term of this patent is extended or adjusted under 35 U.S.C. 154(b) by 0 days.

(21) Appl. No.: 16/402,671

(22) Filed: May 3, 2019

(51) Int. Cl.
*E21B 43/12* (2006.01)

(52) U.S. Cl.
CPC ..... *E21B 43/122* (2013.01)

(58) Field of Classification Search
CPC ..... E21B 43/12; E21B 47/0007; E21B 34/08; E21B 34/04
See application file for complete search history.

(56) References Cited

U.S. PATENT DOCUMENTS

| | | | | |
|---|---|---|---|---|
| 4,600,225 | A | 7/1986 | Blose | |
| 4,706,997 | A * | 11/1987 | Carstensen | E21B 17/042 285/13 |
| 6,047,997 | A | 4/2000 | Olivier | |
| 6,442,826 | B1 | 9/2002 | Staudt et al. | |
| 2012/0193091 | A1* | 8/2012 | Bender | F04B 47/12 166/250.15 |
| 2017/0183945 | A1* | 6/2017 | Tolman | E21B 43/122 |
| 2017/0247989 | A1* | 8/2017 | Casey | F04B 9/1273 |
| 2019/0249509 | A1* | 8/2019 | Jakkula | E21B 33/1208 |

FOREIGN PATENT DOCUMENTS

| | | | |
|---|---|---|---|
| AU | 761378 | B2 | 6/2003 |
| WO | WO 2001/11182 | A1 | 2/2001 |

OTHER PUBLICATIONS

"TKC 4040 HOI"; Hunting; http://www.hunting-intl.com/connection-technology/semi-premium/tkc-4040-hoi; accessed May 3, 2019; 2 pages.
"TKC™ EUE and Plus (TKC PEUE) Connection Technology, Semi Premium"; Hunting; one page.
"Supermax-TS / Supermax-TS2 with Torque Shoulder"; Metal One Corporation; http://www.mtlo.co.jp/mo-con/subermax_ts.html; accessed May 3, 2019; one page.

(Continued)

*Primary Examiner* — Caroline N Butcher
(74) *Attorney, Agent, or Firm* — BakerHostetler

(57) ABSTRACT

An improved plunger lift assembly, system, and method that can be used in all types of oil and gas wells including those of vertical, highly-deviated, S-curved, or horizontal bores. The plunger lift assembly can be part of a plunger lift system used to lift fluid formations out of a wellbore having a production tubing with a drift diameter. The plunger lift assembly may include a mandrel having a chamber, an elastic sealing mechanism, and a shift rod. The sealing mechanism can be disposed about an exterior of the mandrel. The sealing mechanism may be activated by at least one of pressure in the mandrel chamber and vertical force from movement of the mandrel. The shift rod can control fluid flow through the mandrel chamber.

25 Claims, 6 Drawing Sheets

(56) References Cited

OTHER PUBLICATIONS

"3SB™"; Tenaris; http://www.tenaris.com/en/Products/PremiumConnections/LegacySeries/3SB.aspx; © 2003-2019; accessed May 3, 2019; 2 pages.
"TPS Optiflow"; TPS-Technitube Rohrenwerke GmbH; https://www.tps-technitube.com/products/oil-and-gas/tubing-and-casing/tps-optiflow/; © 2018; accessed May 3, 2019; 5 pages.
"USS-Patriot EBM® Premium OCTG Connections"; U.S. Steel Tubular Products; https://usstubular.com/octg-products-and-services/octg-connections/premium-connections-metal-to-metal-seal/uss-patriot-ebm; © 2019; accessed May 3, 2019.

* cited by examiner

SEALING PLUNGER LIFT SYSTEM AND TUBING CONNECTOR

TECHNICAL FIELD

The present disclosure relates to a plunger lift system to lift formation fluid out of a hydrocarbon well. In particular, the present disclosure relates to a novel sealing plunger lift system to lift liquid formations out of a wellbore.

BACKGROUND

As hydrocarbon wells mature, they exhibit a decrease in bottom-hole pressures and the production velocities, which are necessary to carry fluids—e.g., produced water, oil and condensate—to the surface. Over time, these fluids can accumulate in the downhole production tubing, resulting in a condition known as liquid loading. Toward the end of the production life of the hydrocarbon well, as formation fluid accumulates at the bottom of the wellbore, the liquid loading may reach a level that interferes with the well's performance. In particular, the well loses energy as the reservoir's natural pressure is countered by the hydrostatic head created by the accumulated fluid. The lost energy in the well necessitates employing measures to lift the formation fluid to the surface to prevent the liquid-loading condition from killing the well. Several techniques exist for artificially lifting formation fluids, including plunger lift systems. Plunger lift systems attempt to remove fluids from the wellbore so that the well can be produced at the lowest bottom-hole pressure and maximum rate by harnessing the well's own energy to remove the accumulated fluids and sustain gas production. Conventional plunger lift systems rely on a piston dropped into a flowing or non-flowing wellbore. A bumper spring at the bottom of the well cushions the impact of the piston. Gas flowing into the well below the piston pushes the piston upward, thereby pushing any formation fluid toward the surface. These pistons—e.g., pad, solid, bypass, and brush plungers, etc.—may have fluid fallback due to insufficient sealing with the tubing/casing wall.

There are problems with using conventional tubular-shaped plungers in deviated and vertical wells. Such plungers may not have a sufficient seal, thereby causing undesirable fluid fallback to occur. Typical sealing devices are constructed from steel and/or fibers. These seals fail over time. The lack of seal may allow the well to liquid load over time because of fluid fallback. Liquid loading occurs when the hydrostatic pressure of the fluid is greater than the gas pressure below, restricting gas from surfacing through the surface equipment. The conventional tubing coupling collar used in the industry has a gap between each tubing joint. This gap in the inside diameter of the tubing allows fluid to be trapped at each connection and is an obstruction to making contact between the plunger and seal. Contact with artificial lift tools and this tubing/collar gap will cause premature wear, breakage, and fluid fallback.

Thus, there is a need for a plunger lift system that reduces fluid fallback and more efficiently lifts formation fluid to the surface.

SUMMARY

An aspect of the present disclosure provides an improved plunger lift assembly, system, and method that can be used in all types of oil and gas wells including those of vertical, highly-deviated, S-curved, or horizontal bores. The plunger lift assembly of the present disclosure can be part of a plunger lift system or method used to lift fluid formations out of a wellbore having a production tubing with a drift diameter.

In an embodiment, a sealing plunger, alone or in combination with a smooth bore tubing coupler, may eliminate fluid fallback and efficiently lift fluid to the surface. In one aspect of the present disclosure, the reduction and/or elimination of fluid fallback may result from a mechanical interface between a plunger mandrel and tubing or casing walls.

The plunger lift assembly may include a mandrel having a chamber, an elastic sealing mechanism, and a shift rod. The sealing mechanism can be disposed about an exterior of the mandrel. The sealing mechanism may be activated by at least one of pressure in the mandrel chamber and vertical force from movement of the mandrel. The shift rod can control fluid flow through the mandrel chamber.

The sealing mechanism may generally act independently from the mandrel. This allows the mandrel to travel the wellbore and the sealing mechanism to adjust to the inside diameter or drift diameter of the production tubing.

The plunger lift assembly according to one aspect of the present disclosure may further include a set of friction rings for maintaining positioning of the shift rod as the plunger lift assembly ascends and descends within the production tubing.

When the sealing mechanism is not activated, an outer diameter of the sealing mechanism may be substantially equal to or less than the drift diameter of the production tubing. In this way, contact between the plunger lift assembly and the production tubing may be limited during descent of the plunger lift assembly within the production tubing. The sealing mechanism may generally be deactivated (i.e., contracted) during descent of the plunger lift assembly within the production tubing (i.e., toward a bottom of the wellbore).

When the sealing mechanism is activated by at least one or pressure in the mandrel chamber and vertical force from movement of the mandrel, an outer diameter of the sealing mechanism may expand to become substantially equal to the drift diameter of the production tubing. In this way, the sealing mechanism may maintain contact with the production tubing during ascent of the plunger lift assembly within the production tubing. The sealing mechanism may generally be activated during ascent of the plunger lift assembly within the production tubing (i.e., toward a surface of the wellbore).

The plunger lift assembly may further include a plurality of bypass ports. The bypass ports may control fluid flow through the plunger lift assembly. In particular, the bypass ports may permit fluid flow through the plunger lift assembly (e.g., the mandrel chamber) during descent of the plunger lift assembly within the production tubing (i.e., toward the bottom of the wellbore). The bypass ports may further retard fluid flow through the plunger lift assembly (e.g., the mandrel chamber) during ascent of the plunger lift assembly within the production tubing (i.e., toward the surface of the wellbore).

The mandrel can be made of a material selected from the group consisting of plastic, rubber, Teflon, stainless steel, tungsten, titanium, cobalt, silicon, zirconium, chrome-steel, and alloys thereof. The sealing mechanism may similarly be made of a material selected from the group consisting of plastic, rubber, Teflon, stainless steel, tungsten, titanium, cobalt, silicon, zirconium, chrome-steel, and alloys thereof.

In certain embodiments, the sealing mechanism may be made of a rubber compound, such as hydrogenated nitrile butadiene rubber (HNBR).

The sealing mechanism may further include a spring. The spring can expand the sealing mechanism upon activation of the sealing mechanism.

Another aspect of the present disclosure provides for a plunger lift system employing at least one plunger lift assembly as described herein. The plunger lift system can further include a coupler and a connector. The coupler may surround the terminal ends of two adjacent tubing joints of the production tubing such that a gap is defined between the terminal ends of the two adjacent tubing joints. The connector may be disposed within the gap and interconnect the terminal ends of the two adjacent tubing joints. The connector may have an inner diameter that is substantially equal to the inner diameter of each tube joint at its terminal end.

The plunger lift system may further include a surface lubricator. The plunger lift system may also include a bottom-hole component selected from the group consisting of a bumper spring, a stop assembly, and a no-go assembly. The plunger lift system may further include a plurality of plunger lift assemblies.

Another aspect of the present disclosure may provide for a method of lifting fluid formations out of a wellbore using a plunger lift system as described herein. The method may include: placing a bottom-hole component in a bottom of the wellbore near the fluid formations; providing a plunger lift system including at least one plunger lift assembly as described herein; dropping the at least one plunger lift assembly into the wellbore through a production tubing thereof such that the at least one plunger lift assembly descends toward the bottom-hole component; and allowing the at least one plunger lift assembly to ascend within the production tubing in response to formation gases passing into the wellbore, thereby pushing the fluid formations above the at least one plunger lift assembly toward a surface of the wellbore; wherein the at least one of pressure in the mandrel chamber and vertical force from movement of the mandrel causes the sealing mechanism to activate and expand such that an outer diameter of the sealing mechanism becomes substantially equal to a drift diameter of the production tubing and the sealing mechanism maintains contact with the production tubing during ascent of the at least one plunger lift assembly within the production tubing toward the surface of the wellbore.

In certain embodiments, the sealing mechanism may be activated by pressure in the mandrel chamber by engaging the shift rod during the allowing step to permit fluid flow into the mandrel chamber. Alternatively or in addition, the sealing mechanism may be activated by vertical force from movement of the mandrel into a fishing neck of the plunger lift assembly in response to at least one of (a) the plunger lift assembly descending to and impacting the bottom-hole component, and (b) weight of liquid in the wellbore acting upon the at least one plunger lift assembly.

Once the plunger lift assembly reaches a certain level within the production tubing during the allowing step, the shift rod may be disengaged to relieve the at least one of pressure in the mandrel chamber and vertical force from movement of the mandrel, thereby causing the sealing mechanism to deactivate and contract such that the outer diameter of the sealing mechanism is substantially equal to or less than the drift diameter of the production tubing.

The wellbore may be vertical, deviated, S-shaped, or horizontal. The method may be carried out employing a plurality of plunger lift assemblies.

In certain embodiments, the plunger lift system employed in the method may further include a coupler and a connector as described herein.

BRIEF DESCRIPTION OF THE DRAWINGS

The foregoing and other features of the present disclosure will become more fully apparent from the following description, taken in conjunction with the accompanying drawings. These drawings depict only several exemplary embodiments in accordance with the disclosure and are, therefore, not to be considered limiting its scope. The disclosure will be described with additional specificity and detail through use of the accompanying drawings.

DETAILED DESCRIPTION

Figure 1:
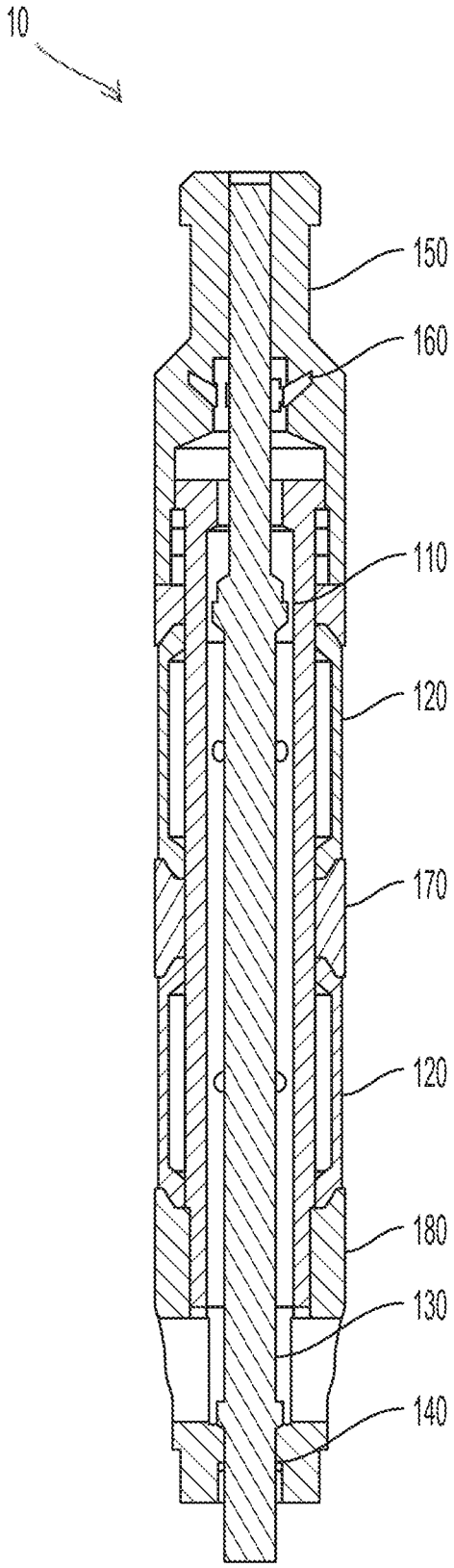
FIG. 1 illustrates a sectional view of one exemplary embodiment of a plunger lift assembly according to the present disclosure, with the plunger lift assembly is in its deactivated, contracted state.
Figure 2:
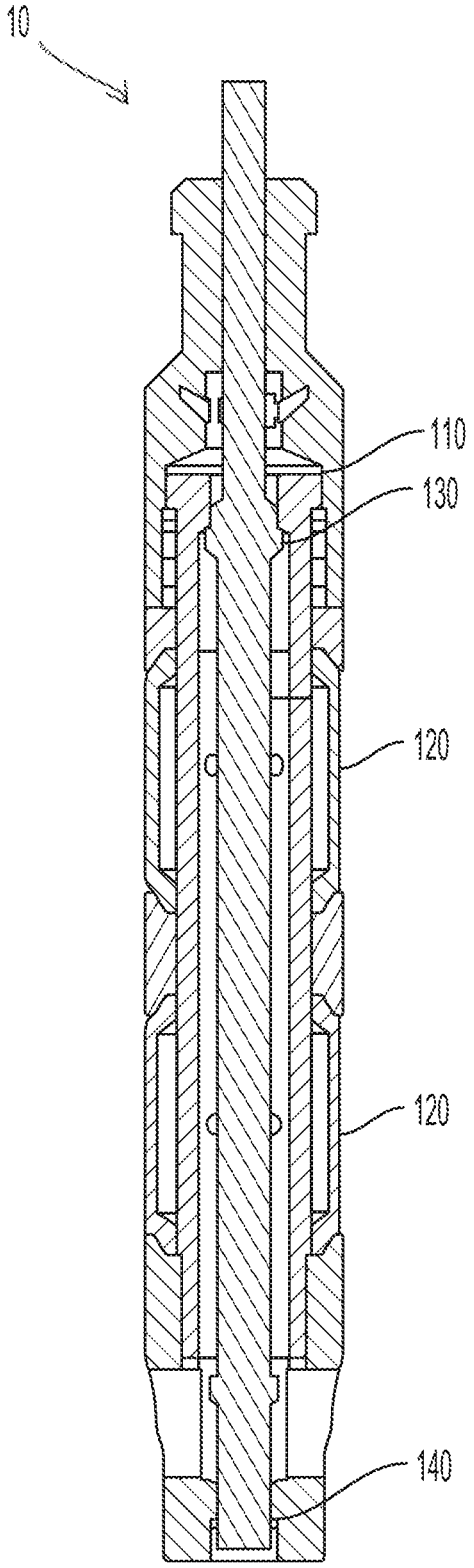
FIG. 2 illustrates a sectional view of the plunger lift assembly of FIG. 1, with the plunger lift assembly in its activated, expanded state.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein and illustrated in the figures, may be arranged, substituted, combined, and designed in a wide variety of different configurations, all of which are explicitly contemplated and make part of this disclosure.

The present disclosure may refer to components as having a length, width, height, and thickness. It is noted that "length" and "width" may be used interchangeably herein, or put another way, these terms may refer to the same dimension or axis. Similarly, the present disclosure may refer to components as having diameter. It is noted that hollow or tubular components may be described as having an outer diameter and an inner diameter. In the case of production tubing of a wellbore, the inner diameter of such tubing may be referred to as having a "drift diameter." As will be readily understood by those skilled in the art, the drift diameter of a production tubing (i.e., the inside diameter guaranteed by the manufacturer according to the specifications) will generally be slightly smaller than the nominal inside diameter. As will be further understood by those skilled in the art, the drift diameter of a production tubing can be guaranteed, for example, by pulling a rabbit (e.g., a cylinder or pipe) of known outside diameter through the production tubing.

Some terms used herein may be relative terms. For example, the terms "upper" and "lower" are relative to each other in location, i.e. an upper component is located at a higher elevation than a lower component in a given orientation, but these terms can change if the device is flipped. The terms "horizontal" and "vertical" are used to indicate direction relative to an absolute reference, i.e. ground level. The terms "above" and "below," "upwards" and "downwards," and "ascend" and "descend" are also relative to an absolute reference; an upwards or ascending flow is against the gravity of the earth.

The term "parallel" should be construed in its lay term as two edges or faces generally continuously having the same distance between them, and should not be strictly construed in mathematical terms as requiring that the two edges or faces cannot intersect when extended for an infinite distance. Similarly, the term "planar" should not be strictly construed as requiring that a given surface be perfectly flat.

As shown in FIGS. 1-4, embodiments of the present disclosure provide for a plunger lift assembly 10 that can be used as part of a plunger lift system and as part of a method for lifting formation fluids out of a wellbore. The plunger lift assembly 10 can be made of any suitable metallic or non-metallic materials, as will be appreciated by those skilled in the art. For example, the plunger lift assembly 10 can be made of materials suitable for harsh-environment wells, such as 4140 steel, titanium, cobalt, or alloys thereof. The material selection for the plunger lift assembly 10 is also made with consideration of the material's integrity to prevent breakage in the wellbore under high velocity situations. Materials such as steel, fiber, rubber, titanium, tungsten, Teflon, and plastics may be used for corrosive and high-friction wellbores.

As can be seen with reference to FIGS. 1-4, the plunger lift assembly 10 may include a mandrel 110. The mandrel 110 may have a chamber 112 with holes therein to direct fluid behind a sealing mechanism 120. The sealing mechanism 120 may be disposed about an exterior of the mandrel 110. The sealing mechanism 120 can be continuous or sectional to increase sealing properties. In the embodiment shown in FIG. 1 and FIG. 2, the plunger lift assembly 10 may include two sealing mechanisms 120, though it is to be understood that any number of sealing mechanisms 120 may be employed vertically or horizontally to increase sealing performance during ascent or reduce descent speed by increasing friction against the production tubing. The plunger lift assembly 10 may further include a shift rod 130 that controls fluid flow through the mandrel 110, namely the chamber 112 thereof. The sealing mechanism 120 can be replaced on the mandrel 110 after sufficient wear occurs. Replacing the sealing mechanism 120 will increase friction properties of the plunger lift assembly 10 to create an efficient seal with the production tubing through the life of the plunger lift assembly 10.

Friction rings 140 may also be provided within the plunger lift assembly 10. The friction rings 140 may generally be positioned about the shift rod 130 and may maintain the positioning of the shift rod 130 as the plunger lift assembly 10 ascends and descends within the production tubing of a wellbore. The friction rings 140 may be made of any suitable material for maintaining the positioning of the shift rod 130, such as, for example, steel, stainless steel, steel alloys, rubber, elastomer, plastic, ceramic, nylon, HNBR, nickel, copper, brass, tungsten, cobalt, and Inconel.

Figure 4:
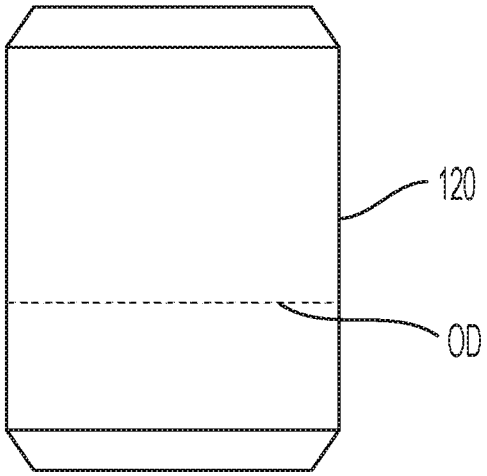
FIG. 4 illustrates a sectional view of one exemplary embodiment of a sealing mechanism according to the present disclosure.

As will be explained in more detail herein, the sealing mechanism 120 may generally define the diameter of the plunger lift assembly and may be used in a well to increase the friction between the plunger lift system and the production tubing (or tubing string) that the plunger lift system travels to increase sealing efficiency. With reference to FIG. 4, the sealing mechanism may be defined as having an outer diameter OD. In an embodiment, the sealing mechanism 120 may be made of an elastic material capable of withstanding the corrosive environment of the wellbore and may further be abrasion-resistant against high-friction environments. In an alternate embodiment, the sealing mechanism 120 may be made of a relatively rigid material, depending on the environment of the wellbore; a rigid sealing mechanism 120 may also be abrasion-resistant against high-friction environments. Example materials from which sealing mechanism 120 may be constructed include steel, stainless steel, steel alloys, rubber, elastomer, plastic, ceramic, nylon, HNBR (hydrogenated nitrile butadiene rubber), Viton, nickel, copper, brass, tungsten, cobalt, and superalloys such as Inconel. In particularly, the sealing mechanism 120 may be an elastic sealing mechanism that is able to be selectively activated and deactivated to control the diameter of the seal mechanism 120. The elastic properties may allow the sealing mechanism 120 to expand and retract repeatedly during the lifecycle of the plunger lift system. Activation (i.e., expansion or compression) and deactivation (i.e., contraction) may be selectively controlled as explained in greater detail herein. For example, the production tubing may have an outer diameter of about 2⅜" and a drift diameter of about 1.901". For such production tubing, the plunger lift assembly 10 can be designed such that the outer diameter OD of the seal mechanism 120 can be about 1.850" (i.e., less than the drift diameter of the production tubing) when deactivated (e.g., FIG. 1) and about 1.900" when activated (i.e., FIG. 2). As will be readily appreciated by those skilled in the art, sealing mechanism 120 can be of any desirable dimensions to suit a particular application (e.g., to be used with any production tubing of a predetermined size). In this way, when the sealing mechanism is activated, the outer diameter OD of the sealing mechanism 120 may be substantially the same as the drift diameter of the production tubing so as to maintain contact and a seal therewith. In use, the seal mechanism 120 may generally be deactivated during descent of the plunger lift assembly 10 (e.g., after dropping the plunger lift assembly 10 into a wellbore) and may generally be activated during ascent of the plunger lift assembly 10. The replaceable sealing mechanism 120 can have a variety of lengths ranging from about 0.1 to about 10 inches and diameters ranging from about 50% of the drift diameter of the production tubing to about 20% greater than the drift diameter of the production tubing to regulate friction and sealing performance. In an embodiment, the replaceable sealing mechanism 120 may have a length of between 0.25 and 5 inches. In an embodiment, the replaceable sealing mechanism 120 may have a length of between 0.5 and 4 inches. In an embodiment, the replaceable sealing mechanism 120 may have a length of between 1 and 3 inches. As will be readily appreciated by those skilled in the art, sealing mechanism can be of any desirable dimensions to suit a particular application.

Figure 3:
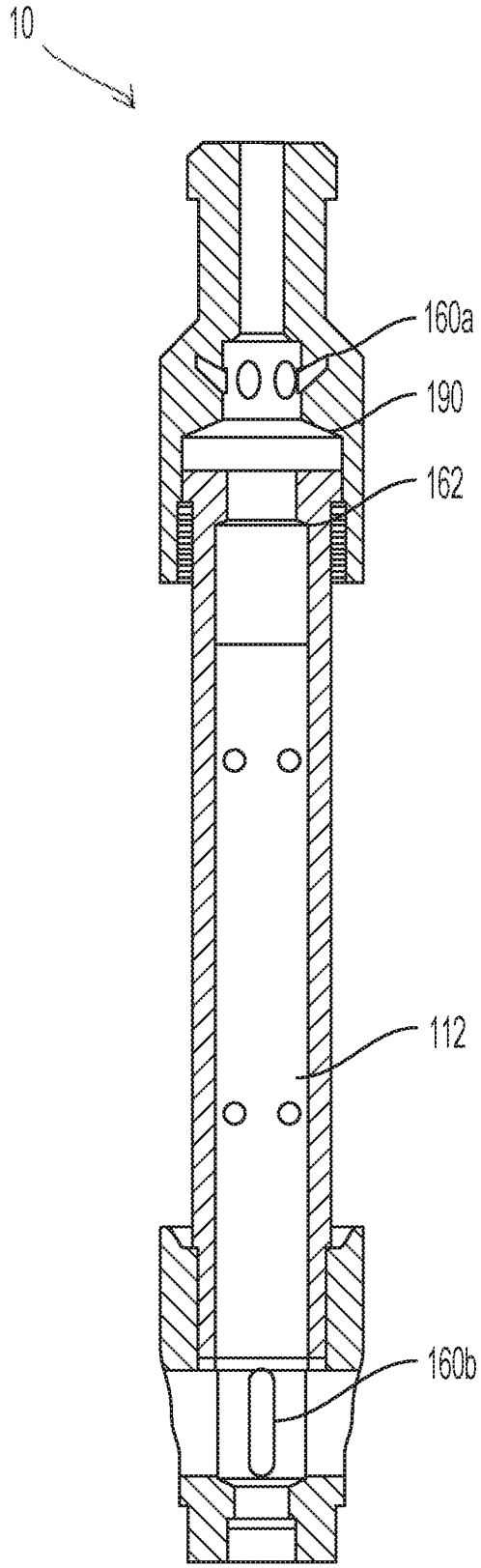
FIG. 3 illustrates a sectional view of one exemplary embodiment of a mandrel according to the present disclosure.

The plunger lift assembly 10 may further include a plurality of bypass ports 160 that may control fluid flow through the plunger lift assembly 10, namely through the mandrel 110 and chamber 112 thereof. For example, during descent of the plunger lift assembly 10, the bypass ports 160 may permit fluid flow through the plunger lift assembly 10, thereby keeping the sealing mechanism 120 deactivated (i.e., in its non-expanded state). On the other hand, during ascent of the plunger lift assembly 10, the bypass ports 160 may retard, restrict, or prevent fluid flow through the plunger lift assembly 10, thereby activating the sealing mechanism 120 (i.e., causing the sealing mechanism to expand) and maintain contact with the production tubing to form a seal that maximizes the amount of the accumulated formation fluids to be lifted out of the wellbore by the plunger lift system 10. The bypass ports 160 may take various forms, such as is shown in FIG. 3. For example, outlet bypass ports 160*a* and inlet bypass ports 160*b* may be provided for directing or controlling fluid travel within the plunger lift assembly.

The plunger lift assembly 10 may further include components designed to retain the sealing mechanism 120 about the mandrel 110. For example, as can be seen with reference to FIG. 1, a seal retaining sleeve 170 may be provided between adjacent sealing mechanisms 120 to aid in retaining an edge of each sealing mechanism 120 against the mandrel 110 as the sealing mechanism is activated and deactivated. Similarly, a seal retainer 180 may be provided to aid in retaining another edge of the sealing mechanism 120 against the mandrel 110 as the sealing mechanism is activated and deactivated that control fluid flow through the plunger lift assembly 10. In certain embodiments, the seal retainer 180 may be designed with bypass ports. As can be seen with reference to FIG. 3, a chamber 190 may be provided to allow movement of the mandrel 110.

As previously described, the mandrel 110 may be provided with one or more vertical or horizontal holes in its chamber 112. In an embodiment, gas or other fluids may be able to travel from the bypass ports 160 (e.g., in the seal retainer 180) and through the cavity within the plunger lift assembly 10, particularly when the plunger lift assembly 10 is ascending within the production tubing of the wellbore. As the fluid flows through the plunger lift assembly 10, the fluid may expand the sealing mechanism 120 from within and transfer pressure through the sealing mechanism 120 to the production tubing around the sealing mechanism 120, thereby activating the sealing mechanism 120 and causing it to expand (i.e., causing the outer diameter OD of the sealing mechanism 120 to become substantially the same as and/or interface with the drift diameter of the production tubing). The plunger lift assembly may also be provided with a fishing neck 150 that may permit the mandrel 110 to move vertically up and down. Similar to the foregoing, movement of the mandrel 110 may provide a squeezing force on the sealing mechanism 120, thereby activating the sealing mechanism 120 and causing it to expand (i.e., causing the outer diameter OD of the sealing mechanism 120 to become substantially the same as the drift diameter of the production tubing). The fishing neck 150 may also have outlet ports that allow for gas and other fluid to flow through the plunger lift assembly 10. With reference to FIG. 3, the mandrel 110 may further include a bypass seal feature 162 that allows fluid to flow through the plunger lift assembly 10 or retards or restricts the flow of fluid through the plunger lift assembly 10 so as to pressurize the mandrel chamber 112.

The sealing mechanism 120 can, in certain embodiments, include a spring that may expand the sealing mechanism 120 and that may ensure that the plunger lift assembly 10 (i.e., the sealing mechanism 120 thereof) maintains contact with the production tubing so as to create a strong seal therebetween as the plunger lift assembly 10 ascends within the production tubing. Alternatively or additionally, the sealing mechanism 120 can be activated and expanded by the formation of fluid pressure within the mandrel chamber 112. Alternatively or additionally, the sealing mechanism can be activated and expanded by movement of the mandrel 110 vertically up into the fishing neck 150, thereby exerting a squeezing action on the sealing mechanism 120.

As previously described, activation and expansion of the sealing mechanism 120 may occur as the plunger lift assembly 10 is beginning its ascent within the production tubing. In this regard, activation and expansion of the sealing mechanism may occur at the bottom of the well bore due to the action of the shift rod 130 and mandrel 110. The friction rings 140 may maintain positioning of the shift rod 130 during ascent of the plunger lift assembly 10 to ensure that the sealing mechanism 120 remains activated and expanded. Due to the equal or near-equal outer and drift diameters of the sealing mechanism 120 and the production tubing, respectively, gas flowing below and inside the seal may enable a seal to be created, comparable to the seals created with conventional solid-body pad plungers. This seal may keep wellbore fluids from falling below the plunger lift assembly 10 while formation fluid(s) may urge the plunger lift assembly 10 and liquid up through the production tubing and toward the surface of the wellbore.

Figure 5:
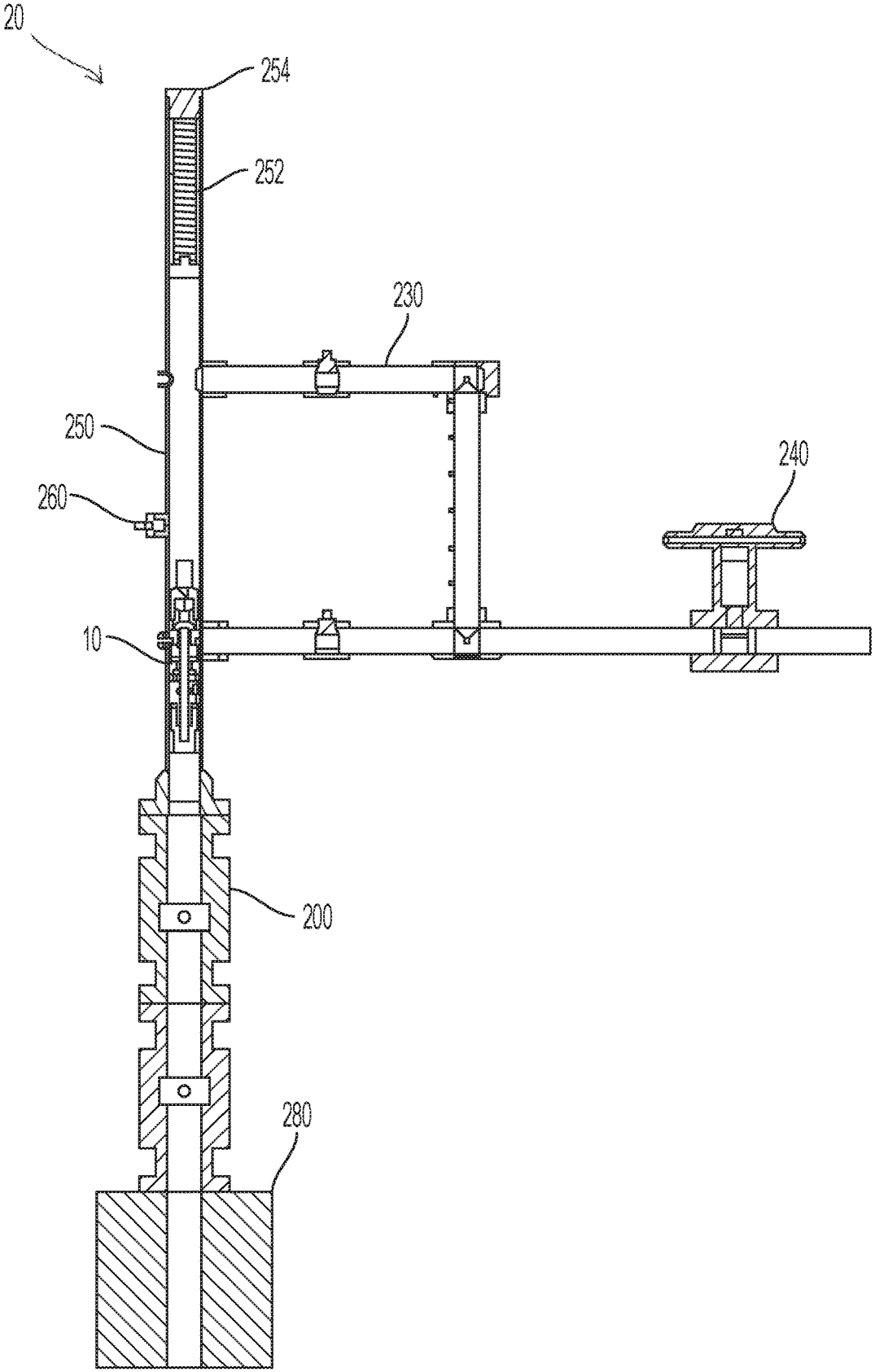
FIG. 5 illustrates a sectional view of one exemplary embodiment of a plunger lift system according to the present disclosure with the plunger lift system in operation in a wellbore.

Turning now to FIG. 5, as will be appreciated by those skilled in the art, the plunger lift system 10 of the present disclosure may be designed as part of a larger plunger lift system 20. The plunger lift system 20 may include a plunger lift system 10 employed in a subsurface wellbore 200 of a wellhead 280. FIG. 5 depicts a plunger lift assembly 10 near the surface of the wellbore 200. The wellhead 280 may include various surface control equipment, including surface flowline piping 230, an automated valve control system 240 (turns the well on and off to control the plunger lift assembly 10), and a surface lubricator having a lubricator body 250, compression spring 252, and spring housing cap 254. Other surface control equipment may include, for example, a plunger catch assembly 260.

Figure 6:
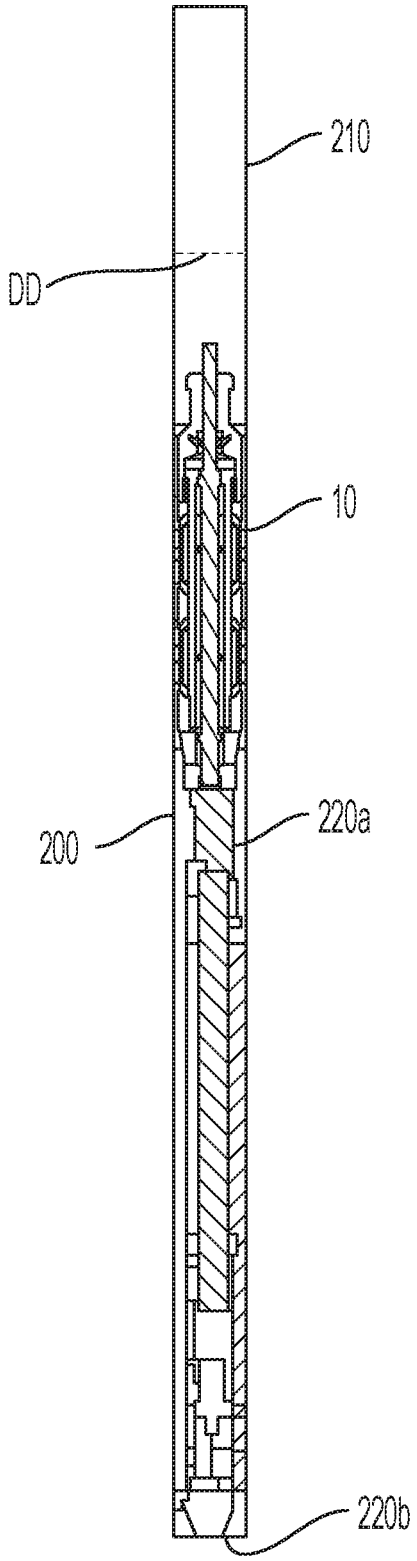
FIG. 6 illustrates a sectional view of the plunger lift system of FIG. 5 after descent into the lower portion of the wellbore.

With reference to FIG. 6, the plunger lift assembly 10 can be better seen employed within a production tubing 210 of the wellbore 200. As previously described, the production tubing 210 may have a drift diameter DD (i.e., the inside diameter guaranteed by the manufacturer according to the specifications by, for example, by pulling a rabbit of known outside diameter through the production tubing). In FIG. 6, the lower portion of the wellbore 200 is visible. At the bottom of the wellbore 200, one or more bottom-hole components may be provided. In the exemplary embodiment illustrated in FIG. 6, a bumper spring assembly 220*a* and a tubing nipple or no-go assembly 220*b* may be provided.

As previously described, the sealing mechanism can be selectively expanded to maintain constant contact with the production tubing 210 or be contracted if necessary. Pressure below the plunger lift assembly 10 may expand the sealing mechanism 120 and urge the plunger lift assembly 10 and fluids toward the surface of the wellbore. Vertical force may also expand the sealing mechanism 120 and urge the plunger lift assembly 10 and fluids toward the surface of the wellbore. For example, upon reaching the bottom-hole component, the shift rod 130 may be engaged (e.g., upon the plunger lift assembly 10 descending to and impacting the bottom-hole component), thereby cutting off the flow of fluid through the plunger lift assembly 10. Upon the retardation, restriction, or prevention of fluid flow through the plunger lift assembly 10, the seal mechanism 120 may be activated and expand. The mandrel 110 may also move vertically upward into the fishing neck 150 upon reaching the bottom-hole component or from the weight of the liquid in the wellbore above the plunger lift assembly 10 acting thereupon. As a result, a squeezing force may be applied to the sealing mechanism 120, causing further expansion of the sealing mechanism 120 to an outer diameter OD that is substantially equal to the drift diameter DD of the production tubing 210 so as to maintain contact with the production tubing 210 when formation fluid(s) become trapped behind the seal. As the plunger lift assembly 10 ascends within the production tubing toward the surface of the wellbore 200, the plunger lift assembly 10 may maintain a strong seal between the sealing mechanism 120 and the production tubing so as to lift the accumulated formation fluids to the surface of the wellbore. The friction rings 140 may further ensure that the shift rod 130 maintains its positioning so that the sealing mechanism 120 remains in its activated and expanded state. The ascent and descent of the plunger lift assembly 10 within the production tubing may not only control gas or other fluid production from the well, but may also serve to scrape any paraffin, scale deposits, deposited or precipitated contaminants, and the like from the wellbore 200 and lift the same to the surface due to the strong seal.

Upon reaching the surface of the wellbore 200 (e.g., upon reaching the lubricator), the shift rod 130 may be disengaged, allowing fluid flow through the plunger lift assembly 10, relieving pressure in the mandrel chamber 112, and permitting the mandrel movement to relax. As a result, the sealing mechanism 120 may deactivate and contract. The fluid flow through the plunger lift assembly 10 may generally maintain the plunger lift assembly 10 in the lubricator (refer to FIG. 5) until it becomes desirable to drop the plunger lift assembly 10 back into the wellbore 200. At that time, a conventional surface controller (not shown) may close a valve on the surface flowline piping to shut-in the well, allowing the plunger lift assembly 10 to begin its descent within the production tubing 210 toward the bottom-hole component once again. The well may be shut-in for a sufficient duration of time to permit the plunger lift assembly 10 to reach the bottom-hole component (refer to FIG. 6). As explained in detail herein, once the plunger lift assembly 10 reaches the bottom-hole component, the sealing mechanism may be activated and may expand to the production tubing. Once a sufficient duration of time has passed to ensure that the plunger lift assembly 10 has reached the bottom-hole component, the shift rod may have engaged the sealing feature of the mandrel 110 to cause pressure to build in the mandrel chamber 112, the plunger lift assembly 10 may have impacted the bottom-hole component, and the weight of the liquid above the plunger lift assembly 10 may have caused the mandrel 110 to move vertically up into the fishing neck 150; each and/or all of these actions may cause activation and expansion of the sealing mechanism 120, and the well may be opened and the plunger lift assembly 10 may begin its ascent within the production tubing 210, lifting the formation fluids to the surface as it ascends. In particular, during the ascent of the plunger lift assembly 10 within the production tubing 210, the sealing mechanism may remain activated and expanded to the production tubing lift formation fluid (e.g., hydrocarbons and liquids) to the surface. As previously described, during the ascent of the plunger lift assembly 10, the friction rings 140 may maintain the positioning of the shift rod 130 against the sealing surface of the mandrel 110 to maintain the sealing mechanism 120 in its activated and expanded state until the plunger lift assembly 10 reaches the surface equipment.

Figure 7B:
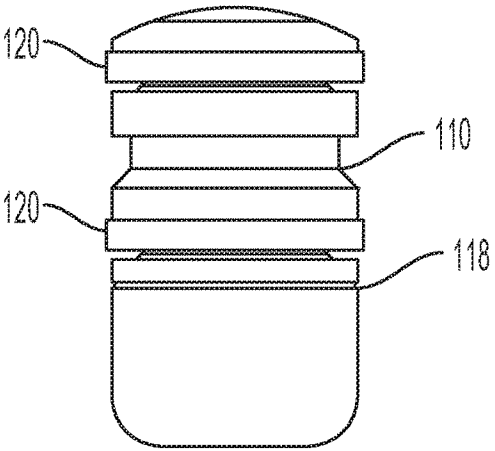
FIG. 7B is a detail view of section A-A of the mandrel of FIG. 7A.
Figure 7A:
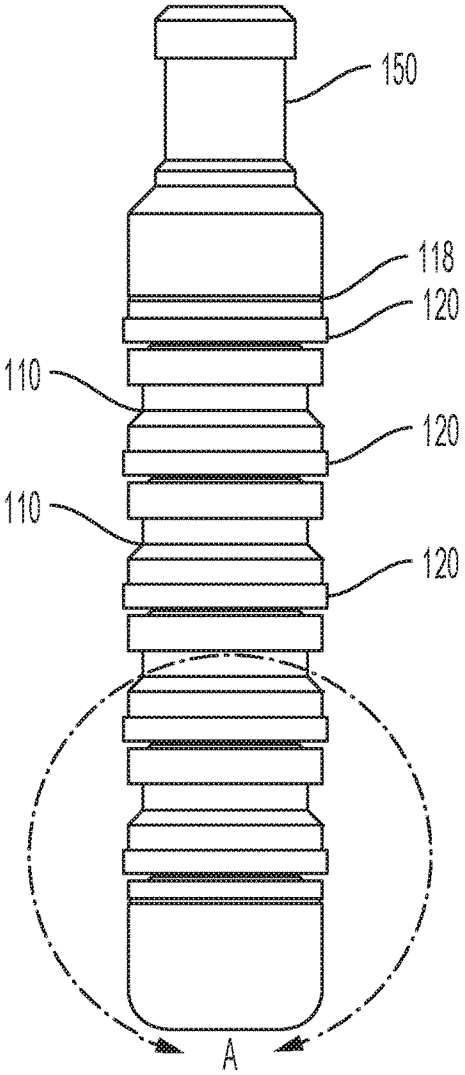
FIG. 7A illustrates one exemplary embodiment of a mandrel and a plurality of sealing mechanisms disposed about the exterior of the mandrel according to the present disclosure.

As illustrated in FIG. 7A and FIG. 7B, the mandrel 110 can be made in a solid state without connections or, alternatively, connections can be added for the replacement of the sealing mechanisms 120. A wear indicator 118 can also be employed to identify when the plunger seal and components are worn and need to be replaced. For example, the sealing mechanism 120 may wear over time due to friction with the production tubing, such that the sealing mechanisms 120 may need to be replaced on the plunger mandrel 110 over time. The wear indicator 118 may be designed to have a diameter that is slightly smaller than the original diameter of the sealing mechanism 120. By way of non-limiting example, if the sealing mechanism 120 is designed with an OD of about 1.90", the wear indicator 118 may be designed with a diameter of about 1.885", such that it becomes clear to an operator that it is time to replace the sealing mechanism 120 once it becomes worn down (e.g., from friction) to the same diameter as the wear indicator 118.

Figure 8B:
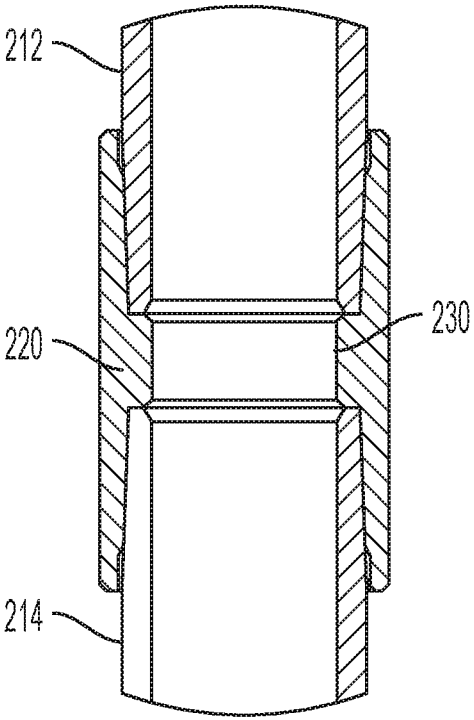
FIG. 8B illustrates a sectional view of the coupler and the two adjacent tubing joints interconnected by a connector according to the present disclosure.
Figure 8A:
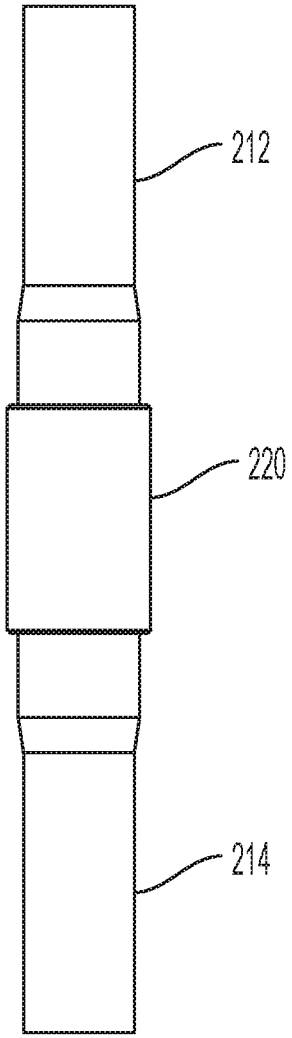
FIG. 8A illustrates an exterior view of two adjacent tubing joints with a coupler.

Shown in FIG. 8A and FIG. 8B is a connection for two adjacent tube joints. In FIG. 8A, a coupler 220 surrounds a first tube joint 212 to a second tube joint 214. As can be seen with reference to FIG. 8B, the coupler 220 surrounds the terminals ends of each of the tube joints 212, 214 such that a gap is defined between the terminal ends of the tube joints 212, 214. In an embodiment, the coupler 220 may be constructed of steel or stainless steel. However, in an alternate embodiment, the coupler 220 can be made from, for example, one or more of the following materials: steel, stainless steel, steel alloys, rubber, elastomer, plastic, ceramic, nylon, HNBR, nickel, copper, brass, tungsten, cobalt, and Inconel. With such a structure, the plunger lift system 10 would be subject to additional friction during ascent and descent when passing and contacting each coupler gap, thereby reducing the usable life cycle of the seals and mandrel. In addition, wellbore fluid often becomes trapped in such gaps and may evacuate the wellbore. A connector 230 was designed to alleviate the foregoing problems. This connector 230 is generally disposed within a preexisting gap and interconnects the terminal ends of the tube joints 212, 214. In an embodiment, the connector 230 has an inner diameter that is substantially the same as the diameter of each tube joint 212, 214 at its terminal end. Due to the now-smooth transition, the connector 230 reduces friction on the sealing mechanism and mandrel as the plunger lift assembly ascends and descends within the production tubing and makes contact therewith. The connector 230 further prevents wellbore fluid from becoming trapped. Overall, the connector 230 improves longevity of the sealing mechanism and reduces fluids from being trapped between adjacent tubing joints, which improvements reduce liquid fallback during the lifting cycle and therefore evacuate more fluid from the wellbore in each cycle. In some embodiments, such as when the connector is connected to the coupler 220, the connector 230 can made be made from the same material as the coupler or the same material as the production tubing joints 212, 214. In other embodiments, such as when the connector is intended as an insert, the connector 230 can made be made from any suitable material that will provide a seal between the connector and the production tubing joints 212, 214.

The above specification, examples, and data provide a description of the structure and use of exemplary embodiments as defined in the claims. Although various embodiments have been described above with a certain degree of particularity, or with reference to one or more individual embodiments, those skilled in the art could make numerous alterations to the disclosed embodiments without departing from the spirit or scope of the present disclosure. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the present disclosure as defined in the following claims.

The invention claimed is:

1. A plunger lift assembly to lift fluid formations out of an associated wellbore having a production tubing with a drift diameter, the plunger lift assembly comprising:

a mandrel having a chamber;

a sealing mechanism disposed about an exterior of the mandrel, the sealing mechanism activated by at least one of pressure in the mandrel chamber and vertical force from movement of the mandrel;

a shift rod for controlling fluid flow through the mandrel chamber; and a plurality of bypass ports that (a) permit fluid flow through the plunger lift assembly during descent of the plunger lift assembly within the production tubing such that the sealing mechanism is not activated and (b) retard fluid flow through the plunger lift assembly during ascent of the plunger lift assembly within the production tubing such that the sealing mechanism is activated.

2. The plunger lift assembly of claim 1, further comprising a set of friction rings for maintaining positioning of the shift rod as the plunger lift assembly ascends and descends within the production tubing.

3. The plunger lift assembly of claim 2, wherein the set of friction rings are positioned about the shift rod.

4. The plunger lift assembly of claim 1, wherein, when the sealing mechanism is not activated, an outer diameter of the sealing mechanism is substantially equal to or less than the drift diameter of the production tubing.

5. The plunger lift assembly of claim 4, wherein, upon activation of the sealing mechanism, an outer diameter of the sealing mechanism expands to become substantially equal to the drift diameter of the production tubing such that the sealing mechanism maintains contact with the production tubing during ascent of the plunger lift assembly within the production tubing.

6. The plunger lift assembly of claim 1, wherein the mandrel is made of a material selected from the group consisting of plastic, rubber, stainless steel, tungsten, titanium, cobalt, silicon, zirconium, chrome-steel, and alloys thereof.

7. The plunger lift assembly of claim 1, wherein the sealing mechanism is made of hydrogenated nitrile butadiene rubber.

8. The plunger lift assembly of claim 1, wherein the sealing mechanism includes a spring, the spring expanding the sealing mechanism upon activation of the sealing mechanism.

9. The plunger lift assembly of claim 1, wherein the sealing mechanism is a replaceable sealing mechanism.

10. The plunger lift assembly of claim 1, further comprising:

a wear indicator disposed about the exterior of the mandrel, the wear indicator having a diameter smaller than an initial diameter of the sealing mechanism such that the wear indicator is configured to visually signal when the sealing mechanism should be replaced.

11. The plunger lift assembly of claim 1, wherein the sealing mechanism is an elastic sealing mechanism.

12. A plunger lift system to lift fluid formations out of a wellbore having a production tubing, the plunger lift system comprising:

at least one plunger lift assembly including:

a mandrel having a chamber;

a sealing mechanism disposed about an exterior of the mandrel, the sealing mechanism activated by at least one of pressure in the mandrel chamber and vertical force from movement of the mandrel;

a shift rod for controlling fluid flow through the mandrel chamber; and a plurality of bypass ports that (a) permit fluid flow through the at least one plunger lift assembly during descent of the at least one plunger lift assembly within the production tubing such that the sealing mechanism is not activated and (b) retard fluid flow through the at least one plunger lift assembly during ascent of the at least one plunger lift assembly within the production tubing such that the sealing mechanism is activated;

a coupler surrounding terminal ends of two adjacent tubing joints of the production tubing such that a gap is defined therebetween; and a connector separate from the coupler, the connector disposed within the gap and interconnecting the terminal ends of the two adjacent tubing joints, the connector having an inner diameter that is substantially equal to the inner diameter of each tube joint at its terminal end.

13. The plunger lift system of claim 12, further comprising a surface lubricator.

14. The plunger lift system of claim 12, further comprising a bottom-hole component selected from the group consisting of a bumper spring, a stop assembly, and a no-go assembly.

15. The plunger lift system of claim 12, wherein the at least one plunger lift assembly comprises a plurality of plunger lift assemblies.

16. The plunger lift assembly of claim 12, wherein the sealing mechanism is an elastic sealing mechanism.

17. A method of lifting fluid formations out of a wellbore using a plunger lift system, the method comprising the steps of:

placing a bottom-hole component in a bottom of the wellbore near the fluid formations;

providing at least one plunger lift system, the plunger lift system comprising at least one plunger lift assembly including:

a mandrel having a chamber;

a sealing mechanism disposed about an exterior of the mandrel, the sealing mechanism activated by at least one of pressure in the mandrel chamber and vertical force from movement of the mandrel;

a shift rod for controlling fluid flow through the mandrel chamber; and a plurality of bypass ports that (a) permit fluid flow through the plunger lift assembly during descent of the plunger lift assembly within the production tubing such that the sealing mechanism is not activated and (b) retard fluid flow through the plunger lift assembly during ascent of the plunger lift assembly within the production tubing such that the sealing mechanism is activated;

dropping the at least one plunger lift assembly into the wellbore through a production tubing thereof such that the at least one plunger lift assembly descends toward the bottom-hole component; and allowing the at least one plunger lift assembly to ascend within the production tubing in response to formation gases passing into the wellbore, thereby pushing the fluid formations above the at least one plunger lift assembly toward a surface of the wellbore;

wherein the at least one of pressure in the mandrel chamber and vertical force from movement of the mandrel causes the sealing mechanism to activate and expand such that an outer diameter of the sealing mechanism becomes substantially equal to a drift diameter of the production tubing and the sealing mechanism maintains contact with the production tubing during ascent of the at least one plunger lift assembly within the production tubing toward the surface of the wellbore.

18. The method of claim 17, wherein, upon the at least one plunger lift assembly descending to and impacting the bottom-hole component, the sealing mechanism is activated by pressure in the mandrel chamber by engaging the shift rod to retard fluid flow through the at least one plunger lift assembly.

19. The method of claim 17, wherein the at least one plunger lift assembly further includes a fishing neck configured to permit upward and downward movement of the mandrel vertically therein, and wherein the sealing mechanism is activated by vertical force from movement of the mandrel into the fishing neck of the plunger lift assembly in response to at least one of (a) the plunger lift assembly descending to and impacting the bottom-hole component, and (b) weight of liquid in the wellbore acting upon the at least one plunger lift assembly.

20. The method of claim 17, further comprising, once the plunger lift assembly reaches a certain level within the production tubing during the allowing step, disengaging the shift rod to relieve the at least one of pressure in the mandrel chamber and vertical force from movement of the mandrel, thereby causing the sealing mechanism to deactivate and contract such that the outer diameter of the sealing mechanism is substantially equal to or less than the drift diameter of the production tubing.

21. The method of claim 17, wherein the wellbore is vertical, deviated, S-shaped, or horizontal.

22. The method of claim 17, wherein the at least one plunger lift assembly comprises a plurality of plunger lift assemblies.

23. The method of claim 17, wherein the plunger lift system further includes:

a coupler surrounding the terminal ends of two adjacent tubing joints of the production tubing such that a gap is defined therebetween; and a connector disposed within the gap and interconnecting the terminal ends of the two adjacent tubing joints, the connector having an inner diameter that is substantially equal to the inner diameter of each tube joint at its terminal end.

24. The method of claim 17, further comprising replacing the sealing mechanism.

25. The method of claim 17, wherein the at least one plunger lift assembly further includes a wear indicator disposed about the exterior of the mandrel, the wear indicator having a diameter smaller than an initial diameter of the sealing mechanism such that the wear indicator is configured to provide a visual signal that the sealing mechanism should be replaced.

* * * * *